United States Patent [19]

Collins, Jr.

[11] Patent Number: 4,586,635

[45] Date of Patent: May 6, 1986

[54] CONICAL DOME COLLAPSIBLE TUBE DISPENSER FOR DISPENSING LIQUIDS

[76] Inventor: Virgil H. Collins, Jr., 958 Sunbury Rd., Columbus, Ohio 43219

[21] Appl. No.: 616,301

[22] Filed: Jun. 1, 1984

[51] Int. Cl.[4] ..... B65D 35/56

[52] U.S. Cl. ..... 222/94; 222/105; 222/181; 222/518; 222/564

[58] Field of Search ..... 222/92, 93, 94, 105, 222/107, 180, 181, 185, 476, 501, 518, 564, 511, 544, 547, 559

[56] References Cited

U.S. PATENT DOCUMENTS

| | | | |
|---|---|---|---|
| 1,614,054 | 1/1927 | Wolkenhauer | 222/93 |
| 1,839,542 | 1/1932 | Ferguson | 222/93 |
| 2,660,339 | 11/1953 | Koob | 222/105 |
| 2,812,880 | 11/1957 | Altman | 222/93 X |
| 3,217,939 | 11/1965 | Murray | 222/501 X |
| 3,220,611 | 11/1965 | Zander et al. | 222/105 X |
| 3,647,122 | 3/1972 | Nigro | 222/501 |

*Primary Examiner*—Joseph J. Rolla
*Assistant Examiner*—Michael S. Huppert
*Attorney, Agent, or Firm*—Anthony D. Cennamo

[57] ABSTRACT

A collapsible tube container with a conical dome opening supported vertically relative to a wall surface in a support housing having a front and rear section of which is extended from a wall surface by elevation of the flat face on the backside. Having the collapsible tube container deposited invertedly inside of front section of the housing with the conical dome protruding through a formed opening in the bottom side of the front section wherein the conical dome opening has a spring pressed dispensing apparatus inside cavity thereof including a ball and stem protruding from the conical dome opening, a spring pressed sealing plug inside of cavity of the conical dome with a flow restrictor to retain the dispensing apparatus with spring tension in the conical dome cavity. Hand pressure applied to the ball and stem will gravitationally dispense liquid into the palm of the hand while a vacuum, created inside of collapsible tube container, controls the flow of liquid therefrom. A cap member provided to close opening in conical dome by pressing and locking the ball and stem into the opening of the conical dome and sealing the liquid inside the collapsible tube container when the tube is stored. A storage compartment is provided in the rear section of the support housing for storing articles such as toothbrushes, toothpaste, combs, tubes of soap, and other personal items.

2 Claims, 5 Drawing Figures

CONICAL DOME COLLAPSIBLE TUBE DISPENSER FOR DISPENSING LIQUIDS

This invention relates to a conical dome collapsible tube means for dispensing liquids such as liquid soaps including a wall supported housing wherein having a collapsible tube with a conical dome opening therein and a spring pressed ball and stem dispensing device protruding therefrom whereby the simple application of hand pressure against ball and stem dispenses liquid therefrom into palm of hand disposed therebeneath.

While it has heretofore been proposed to support and use collapsible containers to dispense paste and liquids, such as, for example, those represented by U.S. Pat. Nos. to Schymizek 2,149,315, Baker 3,101,869, Featherstone 4,203,567, Thiem 4,213,543, and Johnson 4,324,348, such methods suggest using the collapsibility of collapsible tube containers to dispense liquids by mechanically or manually squeezing the container as a means for effecting discharge of contents and further suggest having a support housing with a dispensing apparatus as part of main body being attached to a wall surface. This method of squeezing collapsible containers to dispense liquids causes excessive waste while adhesively mounted wall housings with a dispensing apparatus attached thereto must be detached from wall when defective causing possible damage to the wall surface. Such features are undesireable and otherwise uneconomical due to unnecessary waste and objectional for modern facilities when necessary replacement may cause wall surface damage.

The principal objective of the present invention is to provide a replaceable collapsible tube container with a disposable dispensing apparatus mounted therein and adaptably supported by a housing adhered to a wall surface including a collapsible tube with a conical dome opening therein and supported by a wall mounted housing adhesively attached thereto having a front and rear section hinged together adjacent the lower ends and having a storage compartment thereof in rear section and an opening formed in the underside of front section with a conical dome collapsible tube disposed therein of which a spring pressed ball and stem dispensing device is protruding therefrom disposed downwardly through opening in front section whereby hand pressure against ball and stem gravitationally dispenses liquid into palm of hand of which rate of liquid flow is controlled by vacuum in the collapsible container created by the gravitational flow.

Another objective is the provisions of a wall supported housing with means on the back thereof for permanent adherence to a wall surface.

Another objective is the provisions in a wall mounted housing to provide a dispensing apparatus at the proper distance from a wall surface to allow liquid to be dispensed into palm of hand.

Still another objective is the provisions for a front and rear section in a wall housing wherein a support opening is in the underside of the front section and a storage compartment provided in the rear section.

A further objective is to provide a collapsible tube container with a disposable dispensing apparatus therein.

A further objective is to provide a collapsible tube container with a conical dome opening wherein having a spring pressed ball and stem dispensing device protruding therefrom.

Still a further objective is to provide a very simple and inexpensive wall supported dispensing apparatus wherein the housing can be permanently mounted but the dispensing apparatus is replaced with every new collapsible tube container.

These and other objectives and advantages will be apparent as the specifications are considered with the accompanying drawings, wherein.

Figure 1:
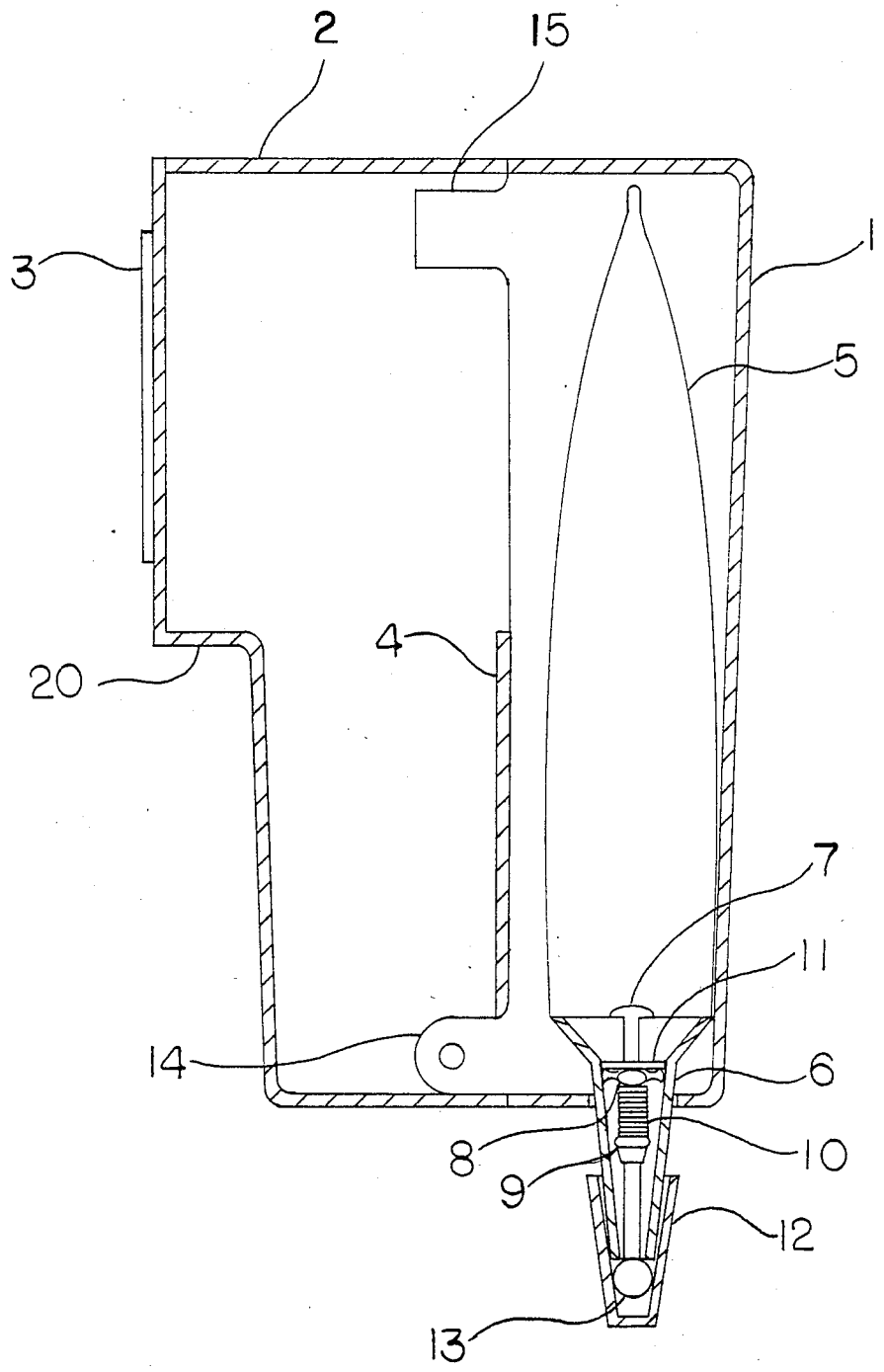
FIG. 1 is a side view of the support housing with the conical dome collapsible tube disposed therein.
Figure 2:
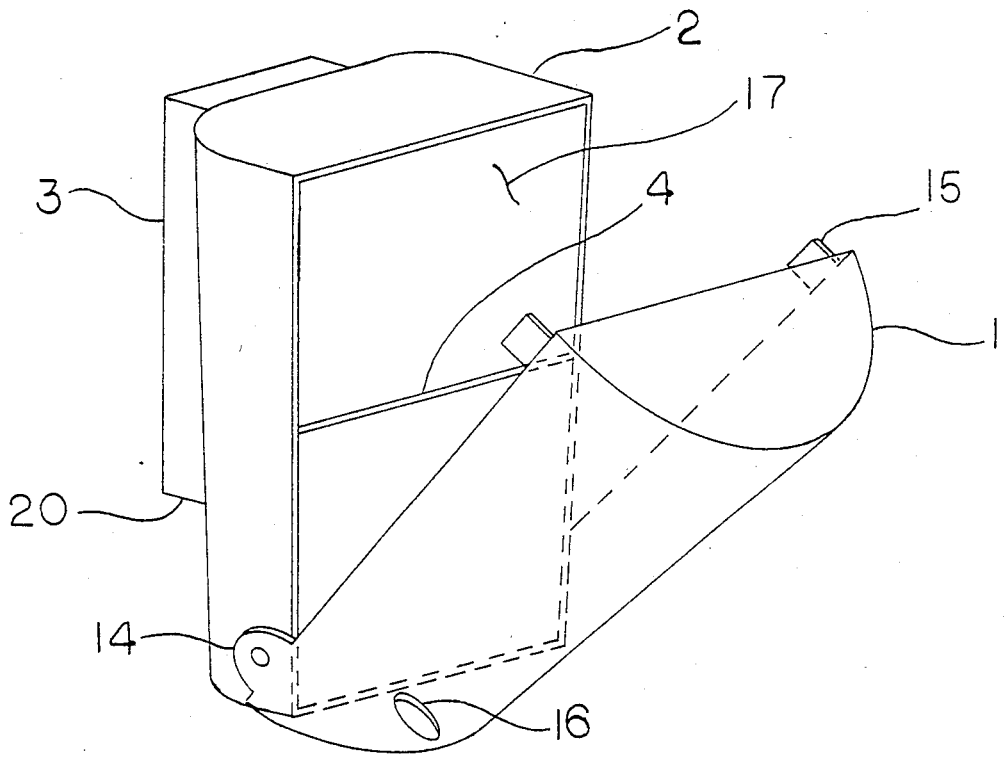
FIG. 2 is a perspective view of the support housing opened showing the front and rear sections.
Figure 3:
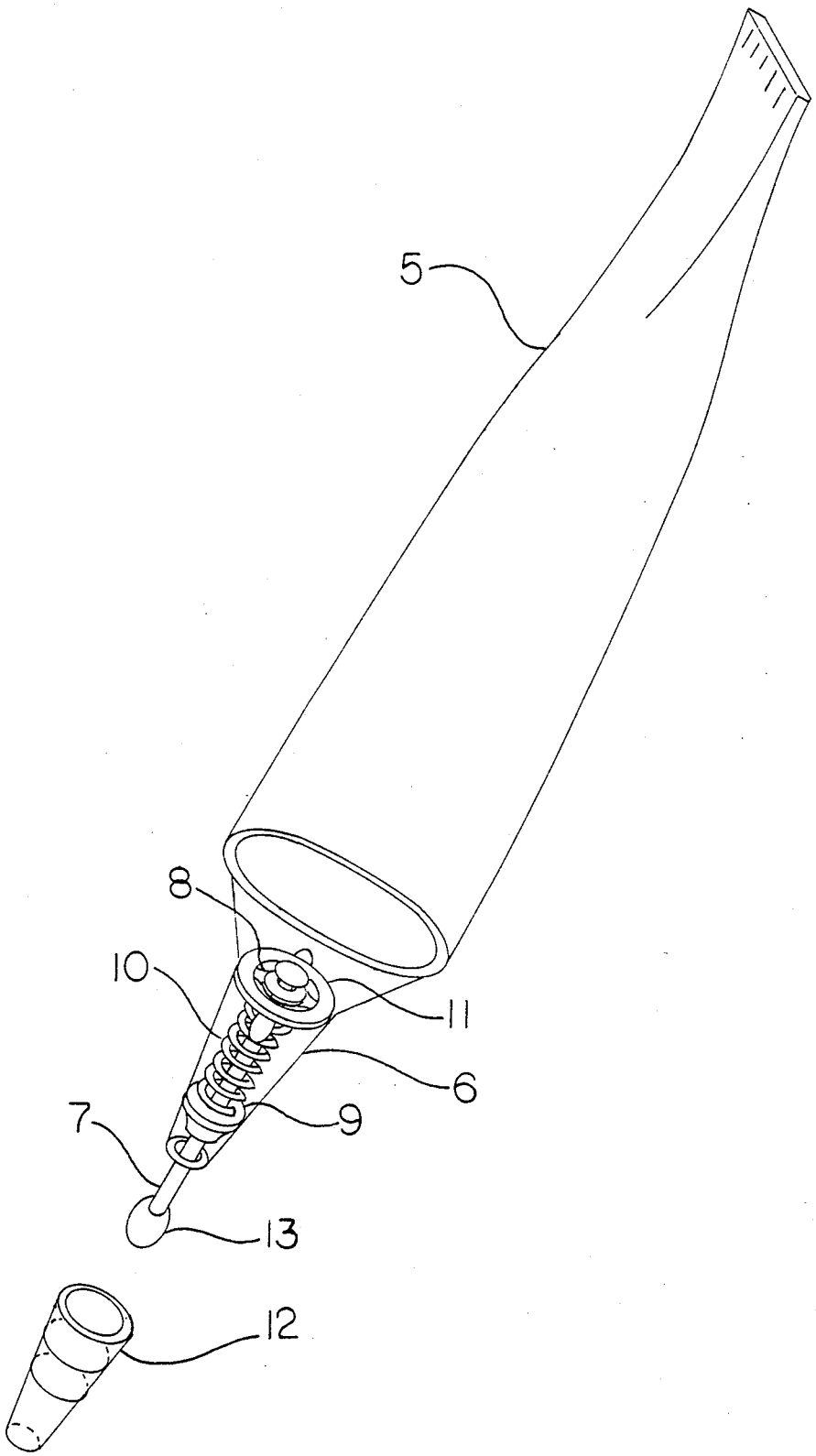
FIG. 3 is a perspective view of the conical dome collapsible tube container with the spring pressed ball and stem dispensing device therein.
Figure 4:
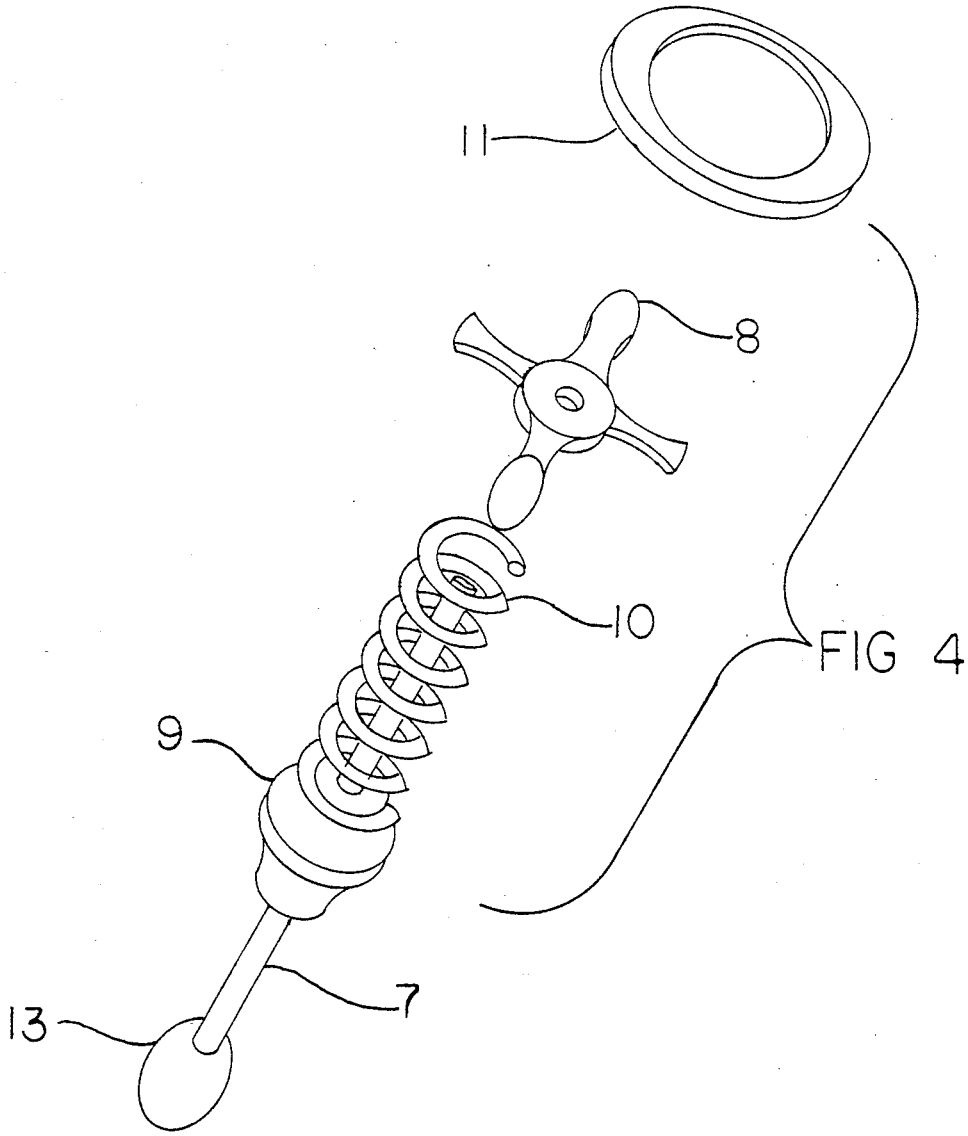
FIG. 4 is an exploded perspective view of the spring pressed ball and stem dispensing device.
Figure 5:
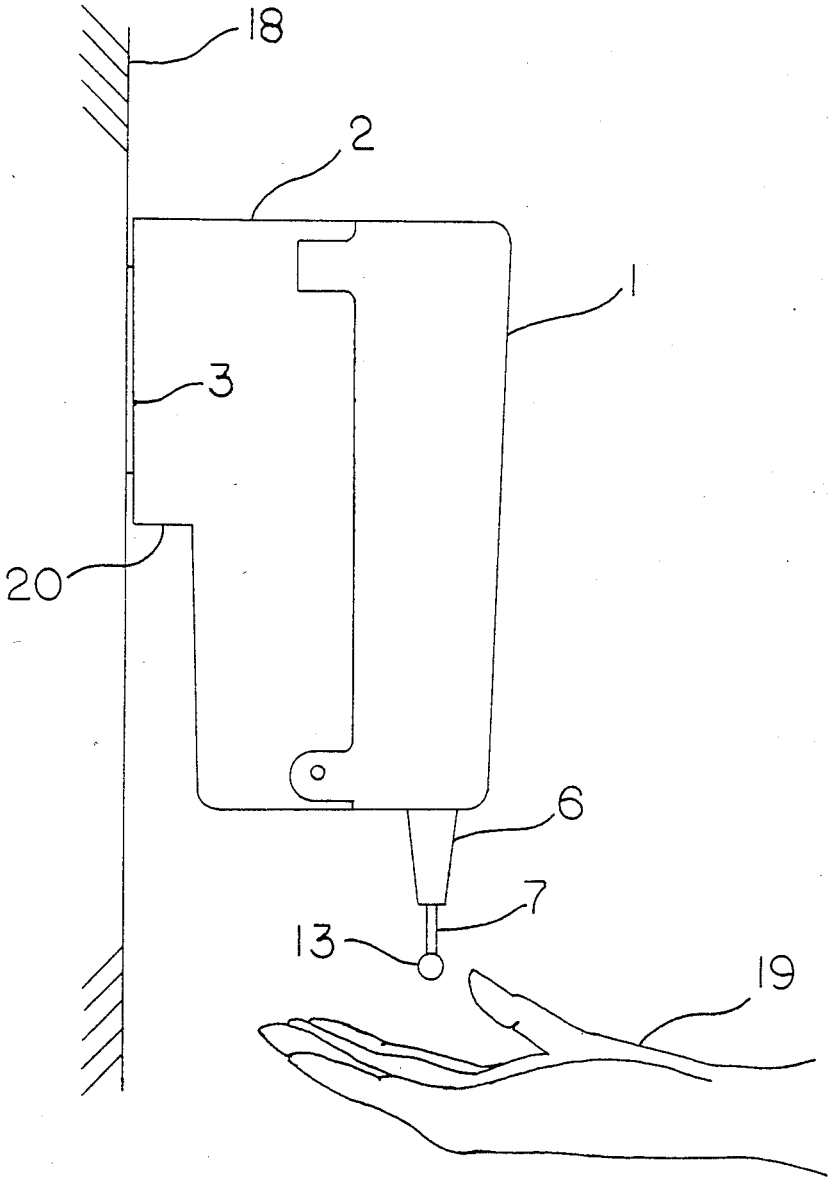
FIG. 5 is a side view of the support housing attached to a wall surface with the dispensing device protruding therefrom at the proper distance from the wall surface to dispense liquid into palm of hand.

Referring more particularly to the drawings, wherein similar reference characters designate like parts throughout the several views, numeral 1 and 2 generally identifies a cylinder shaped housing wherein having a front section 1 with hinged attachment 14 at lower end of rear section 2 and with latch 15 located at upper end of front section 1. Rear section 2, having some suitable tacky adhesive on a flat rear face 3, is permanently or removably adhered to a flat wall surface 18 with an elevation means 20 to substantially position the cylinder shaped portion of housing 1 and 2 away from wall surface 18.

When unlatched at 15, hinge 14 will allow front section 1 to swing outwardly exposing storage compartment 17 in rear section 2 having a divider wall 4 which divides lower half of rear section 2 relative to lower half of front section 1 leaving an opening to storage compartment 17 in upper half or rear section 2. Front section 1 also opens downwardly to give access to opening 16 which is centrally located in the bottom of front section 1.

A collapsible tube container 5 with a conical dome opening, may be invertedly positioned in front section 1 with conical dome 6 projectably mounted through opening 16 exposing conical dome 6 suspended on the underside of front section 1. A cap member 12 suitably shaped to fit closely over tip of conical dome 6 and secured thereto by an internal configuration on the inside walls of cap member 12 which complements a similar configuration on the tip of conical dome 6 allowing cap member 12 to snap onto conical dome 6 and over spring pressed ball 13.

Spring pressed ball 13 is forced into opening of conical dome 6 when cap member 12 is snapped onto tip of conical dome 6 causing ball 13 to plug the opening in conical dome 6 sealing the liquid inside collapsible tube 5. When front section 1 is closed onto rear section 2, latch 15 locks front section 1 in place wherein divider wall 4 supports collapsible tube 5 vertically inside front section 1. When cap member 12 is removed, ball 13, which is attached to stem 7, is forced downward by spring 10 forceably pressing sealing plug 9 down into opening of conical dome 6 preventing the flow of liquid. Spring member 10 is retained by flow restrictor 8 which is of a physical shape to restrict the flow of liquid into the conical dome 6 and also acts as a guide for stem 7. Retainer 11 retains flow restrictor 8 which therefore provides tension to spring 10 which presses sealing plug 9 down into opening of conical dome 6.

The cylinder portion of front section 1 and rear section 2 is extended away from wall surface 18 by the formed elevation 20 of flat rear face 3 therefore positioning spring pressed ball 13 at the proper distance from wall surface 18 to allow liquid to be dispensed into palm of hand 19.

Liquid is dispensed by pushing up on spring pressed ball 13 and stem 7, which is attached to sealing plug 9, forcing sealing plug 9 up from the opening in conical dome 6 which allows liquid to gravitationally flow from collapsible tube 5. As liquid gravitationally flows from collapsible tube 5, a vacuum is created inside collapsible tube 5 causing the walls to collapse while restricting the flow of liquid. The conical shape of the opening prevents air from entering into collapsible tube 5 to replace the dispensed liquid therefore creating a vacuum in tube 5 causing the liquid to flow slowly down stem 7 onto ball 13 into palm of hand 19.

To increase liquid flow, the collapsible tube 5 must be removed from front section 1 and turned up with ball 13 pressed down to permit air to enter collapsible tube 5 and then reinstalled in front section 1. Consequently the more air permitted inside collapsible tube 5 the faster the flow of liquid while less air causes slower flow.

While a perferred embodiment of a collapsible tube dispensing apparatus has been shown and described, it is to be understood that various changes and improvements may be made therein without departing from the scope and spirit of the appended claims.

What I claim is:

1. A collapsible tube dispenser for liquid such as liquid soap comprising: a collapsible tube container having a conical dome with a conical shaped opening therein; a dispenser apparatus in the cavity of said conical dome for dispensing liquid from said collapsible tube container; said dispensing apparatus further comprising:

a ball and stem having said ball and a portion of said stem protruding from said conical dome opening, a sealing plug positioned on said stem inside of said cavity and adjacent said opening in said conical dome, a flow restrictor positioned over the opening in said dispenser, said other end of said stem connected to said flow restrictor, spring means positioned on said stem between said flow restrictor and said sealing plug for urging said sealing plug to close said opening in said conical dome preventing said liquid from flowing from said collapsible tube container;

said liquid from said collapsible tube container being restrictively dispensed from said conical dome when hand pressure is applied to said ball and stem protruding from said opening in said conical dome, and wherein said spring pressed sealing plug is moved away from said conical dome opening;

said conical dome preventing air from entering into said collapsible tube container while inverted;

a conical shaped cap member adapted to closely fit over the tip of said control dome;

said internal wall configuration of said cap member complimenting a snap-lock configuration on said conical dome allowing said cap member to snap lock onto said conical dome over said ball and stem; said cap member pressing said ball and stem into said conical dome opening and thereby sealing said liquid inside of said collapsible tube when said cap member is snap-locked onto said conical dome tip.

2. A support housing for a collapsible tube container with a conical dome opening according to claim 1; said support housing further comprising:

a front and rear section hingedly connected at the lower ends thereof;

a latching means connected at the upper end of said front section to latch said front section to said rear section;

said rear section having adhesive means to adhere said support housing to a wall surface;

said rear section defining a storage compartment therein;

a formed opening in the bottom side of said front section to permit projection of said conical dome of said collapsible container;

means on said front section to vertically support said collapsible tube container when said front section is attached to said rear section;

a formed elevation means on said backside of said rear section to extend said housing from said wall surface at a distance for dispensing liquid.

* * * * *